United States Patent [19]

Graffam

[11] 4,317,393

[45] Mar. 2, 1982

[54] EXTENSIBLE TORQUE BAR

[76] Inventor: Kenneth Graffam, 145 Viola Rd., Suffern, N.Y. 10901

[21] Appl. No.: 181,399

[22] Filed: Aug. 25, 1980

[51] Int. Cl.[3] ..... B25G 1/04

[52] U.S. Cl. ..... 81/177 A; 403/107

[58] Field of Search ..... 81/177 R, 177 A, 177 E; 403/107, 118, 406

[56] References Cited

U.S. PATENT DOCUMENTS

| | | | |
|---|---|---|---|
| 2,438,633 | 3/1948 | Condor | 403/107 |
| 2,520,652 | 8/1950 | Pfauser et al. | 81/177 A X |
| 2,592,978 | 4/1952 | Trimboli | 81/177 A X |
| 2,963,930 | 12/1960 | Clothier et al. | 81/177 A |
| 3,188,895 | 6/1965 | Jones | 81/177 F |
| 3,227,015 | 1/1966 | Tremblay | 81/177 |
| 3,306,639 | 2/1967 | Lyon | 403/107 |
| 3,710,645 | 1/1973 | Bennett | 403/107 X |
| 4,070,932 | 1/1978 | Jeannotte | 81/177 A |
| 4,102,375 | 7/1978 | Rossini | 81/177 A X |

*Primary Examiner*—James G. Smith

[57] ABSTRACT

An extensible torque bar is provided. The torque bar comprises an elongated torque sleeve having a channel therein. A drive engagement means is provided at one end of the sleeve for engaging a drive tool, e.g. a ratchet wrench, for applying torque to the sleeve. An elongated torque rod is provided having a portion of the length of the rod adapted to slidably and nonrotatably mate within the channel of the torque sleeve. A driven engagement means is provided at one end of the rod for engaging a driven tool, e.g. a socket wrench, for applying torque to the tool. The rod has internal screw threads along the portion of its length which is adapted to slidably and nonrotatably mate within the channel. A cylindrical adjustment member, rotatably and longitudinally mounted to the sleeve, is provided having external screw threads cooperably engaging the internal screw threads on the rod. When the cylindrical adjustment member is rotated the rod extends from or retracts into the sleeve.

5 Claims, 4 Drawing Figures

EXTENSIBLE TORQUE BAR

BACKGROUND OF THE INVENTION

1. Field of the Invention

This invention relates to extensible torque bars of the type used for driving socket wrenches and like devices.

2. Prior Art

In the use of wrenches, e.g. ratchet wrenches, and the like it is often necessary or convenient to have an elongated member through which a torque may be transmitted at a distance between its source of application and the tool immediately applying the torque. Since the need for such a member may arise in many different situations, it is desireable to have a device wherein the length of the member may be varied. This general type of tool, i.e. an extensible torque bar, is known to persons skilled in the art.

Such an extensible torque bar must be readily adjustable to a desired length and must also be capable of transmitting an applied torque without damage to the bar itself. If it also desireable to provide an extensible torque bar which, by simple and convenient manipulation may be lengthened or shortened to any desired length between a minimum and maximum. Such variation in the length of the bar is essential in order to gain access to machine parts at different locations on the machine. It is also highly desireable to have an extensible torque bar which can be adjusted without removing it from the machine part, for example, a nut being tightened or loosened. Thus the means for extending or retracting the torque bar should be easily accessible to the user.

Extensible torque bars and similar devices are known in the art. For example, the following U.S. patents are directed to extensible torque bars or tool shanks;

U.S. Pat. No. 2,438,633 to Condor;

U.S. Pat. No. 2,963,930 to Clothier et al;

U.S. Pat. No. 3,227,015 to Tremblay; and

U.S. Pat. No. 3,306,639 to Lyon.

All of these devices cannot be adjusted while the driven tool, e.g. the socket wrench, is in place. The tool must be taken off, for example, the bolt to extend or retract the device. Additionally, the devices do not provide an infinite variation of length between their minimum and maximum extensions i.e. there are definite finite positions on the device between minimum and maximum extensions.

Additionally, of interest are the following U.S. patents:

U.S. Pat. No. 2,520,652 to Pfauser et al;

U.S. Pat. No. 2,592,987 to Trimboli;

U.S. Pat. No. 3,188,895 to Jones; and

U.S. Pat. No. 4,070,932 to Jeannotte.

All of these relate to tools which may be extended but do not relate to extensible torque bars or tools shanks.

OBJECTS AND SUMMARY OF THE INVENTION

It is an object of this invention to provide an extensible torque bar of simple and economical construction.

It is a further object of this invention to provide an extensible torque bar which can be conveniently extended or retracted to be adapted to a particular use.

It is still a further object of this invention to provide an extensible torque bar which has an infinite number of positions between minimum and maximum extension.

It is still a further object of this invention to provide an extensible torque bar wherein the length of the torque bar may be changed simply and easily without removing the tool from the object, e.g. bolt, that is being torqued.

The foregoing objects of this invention are obtained by an extensible torque bar comprising:

an elongated torque sleeve having a channel therein and a drive engagement means at one end of the sleeve for engaging a drive tool for applying torque to the sleeve;

an elongated torque rod having a portion of the length thereof adapted to slidably and nonrotatably mate within the channel of the torque sleeve and a driven engagement means at one end of the rod for engaging a driven tool for applying torque to the tool, the rod having internal screw threads along the portion of the length of the rod adapted to slidably and nonrotatably mate within the channel;

a cylindrical adjustment member rotatably and longitudinally mounted to the sleeve, the member having external screw threads cooperably engaging the internal screw threads, whereby when the cylindrical adjustment member is rotated the bar extends from or retracts into the sleeve.

While the foregoing are the principle objects of this invention, other objects will be readily apparent from the detailed description to follow.

BRIEF DESCRIPTION OF THE DRAWINGS

Reference is now made to the accompanying drawings, wherein like numbers of reference refer to similar parts throughout, and in which.

DETAILED DESCRIPTION OF THE INVENTION

Referring more particularly to the drawings, FIGS. 1–4 depict a preferred embodiment of a torque bar of this invention, generally, designated (10). The torque bar (10) is comprised of an elongated torque sleeve (12), preferably having a noncircular channel (14) therein. The channel (14) is axially aligned in the sleeve (12) and extends longitudinally therethrough. Preferably, as indicated more clearly in FIG. 3, the shape of the channel (14) is substantially square. The substantially square channel (14) is preferred due to ease of construction and the relative resistance to shearing torque.

Figure 1:
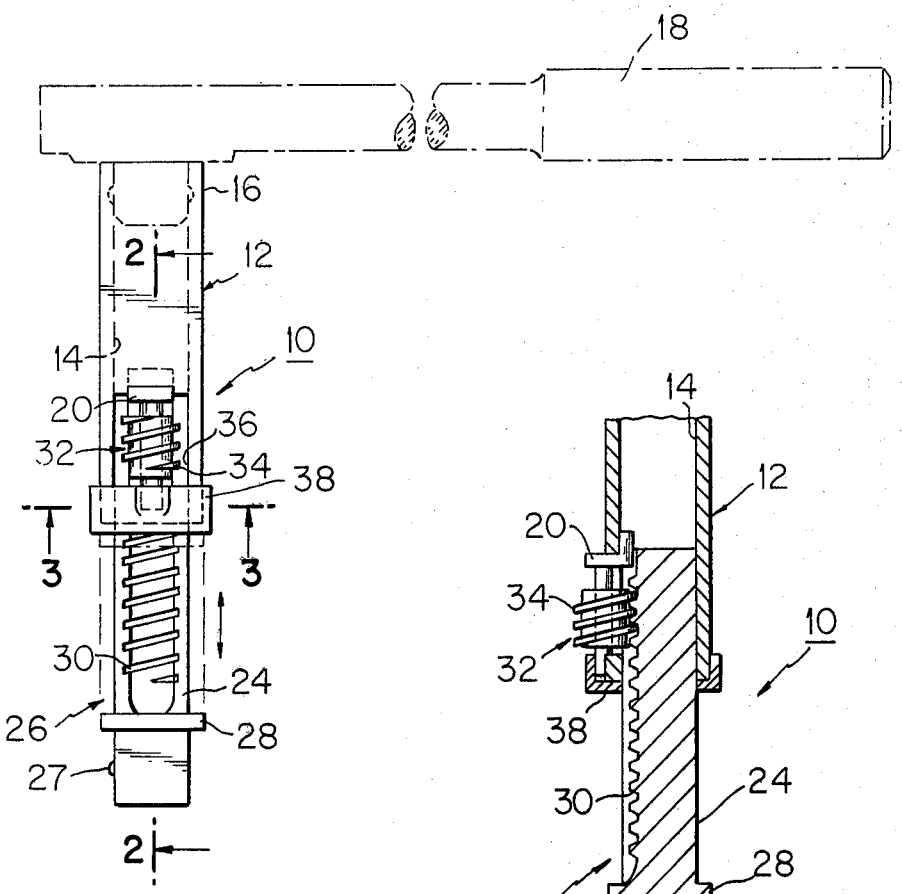
FIG. 1 is a longitudinal view of an embodiment of the extensible torque bar of this invention.
Figure 2:
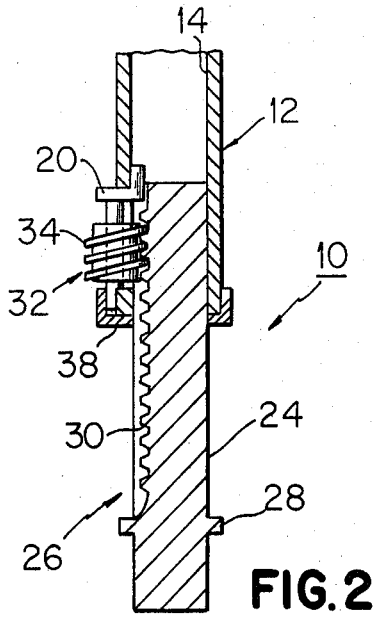
FIG. 2 is a partial longitudinal view of the extensible torque bar depicted in FIG. 1 taken along line 2—2 of FIG. 1.
Figure 4:
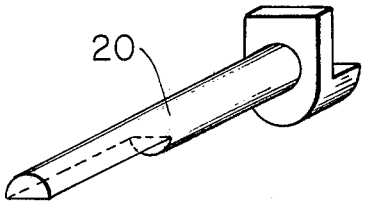
FIG. 4 is a perspective view of shaft member (20).
Figure 3:
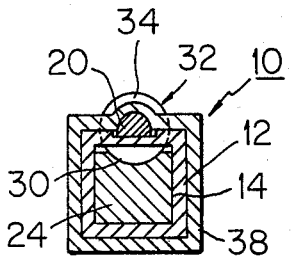
FIG. 3 is a cross sectional view of the extensible torque bar depicted in FIGS. 1 and 2 taken along line 3—3 of FIG. 1.

As depicted in FIG. 1, a drive engagement means (16) is provided at one end of the torque sleeve (12) for engaging a drive tool (18), designated in phantom lines, for applying torque to the sleeve (12). Preferably the drive engagement means (16), as indicated in FIG. 1, is a substantially square channel the same size as channel (14) in the torque sleeve (12). This results in a channel (14) of equal size over its entire length. The torque sleeve (12) may be of any desired length. Torque is applied to the torque sleeve (12) by an external source adapted to operatively connect to the drive engagement means (16) by a fixture inserted within the end of channel (14). The channel (14) is thus of such a size so as to receive ordinary torque tools of commerce, e.g. a ratchet wrench (18).

The extensible torque bar (10) is further comprised of an elongated torque rod (24) having a portion of the length thereof adapted to slidably and nonrotatably mate within channel (14) of torque sleeve (12). The elongated torque rod (24) has a driven engagement means (26) at one end of the rod (24) for engaging a driven tool (not shown), e.g. a socket wrench, for applying torque to the tool. Preferably the driven engagement means (26) includes a substantially square driving surface having at least one spring bias ball (27) therein.

As indicated in the illustrated embodiment, the elongated torque rod (24) preferably has a substantially square cross sectional area which mates with channel (14). A collar (28) somewhat larger than channel (14) is provided to prevent the torque rod (24) from passing through the channel (14). As illustrated, the engagement means (26) is preferably a socket holder, adapted to receive the ordinary socket wrenches of commerce (not shown). As the occasion arises, the engagement means may be adapted to receive various other tools. Preferably, the torque rod (24) is substantially square throughout its length and is of a size to it snuggly within the channel (14) and provide sufficient clearance for longitudinal motion therein.

The relative size of the torque sleeve (14) and the torque rod (24) therein and the material from which it is constructed must be selected so as to give the elongated torque rod (24) sufficient resistance to a shearing torque of a magnitude for which the tool is to be used.

The torque rod (24) further includes internal screw threads (30) or their equivalent along the portion of the length of the rod (24) which is adapted to slidably and nonrotatably mate within the channel (14). A cylindrical adjustment member (32) is rotatably and longitudinally mounted to the sleeve (14). The cylindrical adjustment member (32) includes external screw threads (34), or their equivalent, which cooperably engages the internal screw threads (30) formed on the torque rod (24). Thus when the cylindrical adjustment member (32) is rotated the external screw threads (34) engage the internal screw threads (30) which move rod (24) longitudinally through sleeve (14). The elongated torque rod (24) thus extends from or retracts into the sleeve (14).

Preferably the cylindrical adjustment means (32) is mounted on a shaft member (20) FIG. (4) which is longitudinally mounted across an opening (36) in the elongated sleeve (12). A cap (38) may be provided to maintain the shaft member (20) in position on the sleeve (12). The cylindrical adjustment member (32) is in such a position that one may easily reach it while the tool is engaged with, for example, a bolt.

The advantages of the aforedescribed extensible torque bar (10) are that it has an infinite number of positions between the maximum and minimum extended positions and can be easily extended or retracted while the tool, e.g. socket wrench, is in use by the mere manuevering of member 932) by a thumb or other finger. Additionally, a locking means is not required for preventing the torque rod from extending or retracting from the desired position and the torque rod cannot accidentially extend out of the sleeve.

Preferably, it is desirable to construct the various parts of the invention from steel, particularly a tool type steel. The material is not critical however, and other materials having similar properties would suffice. The various parts of the invention may be formed by methods well known to persons skilled in the art of metal forming.

Although the foregoing description is of necessity detailed in order that a specific embodiment of the invention may be set forth, it is be understood that the specific terminology and structure are not intended to be limiting and rearrangement of parts and modification of detail may be resorted to without departing from the scope or spirit of the invention.

What is claimed is:

1. An extensible torque bar comprising:

an elongated torque sleeve having a channel therein, and a drive engagement means at one end of the sleeve for engaging a drive tool for applying torque to the sleeve;

an elongated torque rod having a portion of the length thereof adapted to slidably and nonrotatably mate within the channel of the torque sleeve and a driven engagement means at one end of the rod for engaging a driven tool for applying torque to the tool, the rod having internal screw threads along the portion of the length of the rod adapted to slidably and nonrotatably mate within the channel, a cylindrical adjustment member rotatably and longitudinally mounted to the sleeve, the member having external screw threads cooperably engaging the internal screw threads, whereby when the cylindrical adjustment member is rotated the elongated torque rod extends from or retracts into the sleeve.

2. The extensible torque bar of claim 1, wherein the channel and rod are substantially square.

3. The extensible torque bar of claim 1, wherein the cylindircal adjustment member is mounted on a shaft member longitudinally mounted across an opening in the sleeve.

4. The extensible torque bar of claim 1, wherein the driven engagement means includes a substantially square driving surface having at least one spring biased ball therein.

5. The extensible torque bar of claim 2, wherein the drive engagement means includes a substantially square channel the same size as the channel in the torque sleeve.

* * * * *